United States Patent [19]
Matsumoto et al.
[11] 4,302,257
[45] Nov. 24, 1981

[54] PROCESS FOR PRODUCING A GRAIN-ORIENTED SILICON STEEL SHEET

[75] Inventors: Fumio Matsumoto, Kitakyusyushi; Jirou Harase; Kunihide Takashima, both of Munakatamachi; Hisanobu Nakayama, Nogatashi, all of Japan

[73] Assignee: Nippon Steel Corporation, Tokyo, Japan

[21] Appl. No.: 166,112

[22] Filed: Jul. 7, 1980

Related U.S. Application Data

[63] Continuation of Ser. No. 19,894, Mar. 12, 1979, abandoned.

[30] Foreign Application Priority Data

Mar. 11, 1978 [JP] Japan ..... 53-28107

[51] Int. Cl.[3] ..... H01F 1/04
[52] U.S. Cl. ..... 148/111; 148/31.55
[58] Field of Search ..... 148/110, 111, 112, 113, 148/31.55

[56] References Cited

U.S. PATENT DOCUMENTS

| | | | |
|---|---|---|---|
| 2,209,687 | 7/1940 | Crafts | 148/111 |
| 3,413,165 | 11/1968 | Buchi et al. | 148/111 |
| 3,764,406 | 10/1973 | Littmann | 148/111 |
| 3,802,937 | 4/1974 | Kohler et al. | 148/111 |
| 3,841,924 | 10/1974 | Sakakura et al. | 148/111 |
| 3,846,187 | 11/1974 | Sakakura et al. | 148/111 |
| 3,872,704 | 3/1975 | Ohya et al. | 148/111 |
| 3,971,678 | 7/1976 | Vlad | 148/111 |
| 3,976,517 | 8/1976 | Blank et al. | 148/111 |
| 4,066,479 | 1/1978 | Shimoyama et al. | 148/111 |
| 4,123,299 | 10/1978 | Fiedler et al. | 148/111 |
| 4,202,711 | 5/1980 | Littmann et al. | 148/111 |
| 4,204,891 | 5/1980 | Shiozaki et al. | 148/111 |

*Primary Examiner*—L. Dewayne Rutledge
*Assistant Examiner*—John P. Sheehan
*Attorney, Agent, or Firm*—Wenderoth, Lind & Ponack

[57] ABSTRACT

Process for producing a grain-oriented silicon steel sheet from silicon steel slabs, particularly from continuously cast steel slabs, comprising at least one recrystallization rolling at high reduction rate in a temperature range from 1190° C. to 960° C. in the hot rolling step. The process of the present invention is very effective in preventing the streaks of smaller, poorly oriented grains very often seen in the final product produced from silicon steel slabs.

5 Claims, 16 Drawing Figures after first pass after second pass,
20% reduction after second pass,
30% reduction after second pass,
50% reduction

PROCESS FOR PRODUCING A GRAIN-ORIENTED SILICON STEEL SHEET

This is a continuation of application Ser. No. 19,894, filed Mar. 12, 1979, now abandoned.

BACKGROUND OF THE INVENTION

1. Field of the Invention

The present invention relates to a process for producing a grain-oriented silicon steel sheet having a grain orientation of {110}<001> which is easily magnetized in the rolling direction, more particularly to a silicon steel sheet of this type which is free from streaks of smaller, poorly oriented grains.

2. Description of Prior Art

As is well known, a grain-oriented silicon steel sheet having excellent magnetic properties in the rolling direction can be obtained by subjecting a silicon steel sheet to secondary recrystallization. In this process an important role is played by inhibitors, such as MnS and AlN which must be effectively controlled to obtain a satisfactory final product.

In the prior art processes, steel slabs are heated to high temperatures (for example 1300° C. or higher) so as to fully dissolve the inhibitor elements prior to hot rolling and the inhibitor elements are controlled in the subsequent steps including hot rolling.

The temperatures to which the slabs are heated are very much higher than the temperatures used for ordinary steel grades and this very often results in excessive grain growth. Coarse grains having the <110> zone grain axis parallel to the rolling direction are not fully broken down and remain in the subsequent steps including the hot rolling step. As a result, secondary recrystallization in the final annealing is incomplete and the incompletely recrystallized grains remain in the final product as streaks of smaller, poorly aligned grains which will be referred to simply as streaks hereafter in this specification.

On the other hand, if the slab is heated only to a relatively low temperature (for example, 1300° C. or lower), the inhibitors are not thoroughly dissolved with the result again being incomplete secondary recrystallization. In this case, streaks appear over the entire surface of the sheet.

In recent years, the old ingot-making process has been giving way to the continuous casting process. However, continuous slabs develop a columnar structure because of the unavoidable rapid cooling and solidification that characterizes the continuous casting process. In the production of grain-oriented silicon steel sheets, therefore, abnormal coarsening of the grains is more likely to occur during the high temperature slab heating step in continuous slabs than in slabs produced by the conventional process of ingot-making and breaking down. This abnormal coarsening of the grains is the principal cause of streaks in the products after the final annealing.

For prevention of streaks in products from continuously cast steel slabs, U.S. Pat. No. 3,764,406 and No. 3,841,924 disclose a method in which a continuous slab is preliminarily heated and rolled prior to the hot rolling step, so as to prevent the coarsening of grains during the high temperature slab heating in the subsequent hot rolling step.

As, however, the industrial advantage of the continuous casting method over the ingot-making method derives mainly from the elimination of the break-down step, the preliminary heating and rolling prior to the hot rolling step required in these prior-art methods greatly reduces the significance of the continuous casting method.

SUMMARY OF THE INVENTION

The present inventors have conducted extensive studies on various phenomena in the hot rolling of continuous steel slabs and have succeeded in producing a grain-oriented silicon steel sheet free from the above mentioned defects by employing specific treating conditions as defined hereinafter.

One of the objects of the present invention is to provide a process for producing a grain-oriented silicon steel sheet which takes full advantage of the continuous casting process and which prevents the occurrence of streaks in the final product.

Another object of the present invention is to produce a grain-oriented silicon steel sheet having a high level of magnetic flux density but a low core loss value from a continuous steel slab.

Other objects of the present invention will be clear from the following description and examples as well as the attached drawings.

The present invention is also applicable to the production of grain-oriented silicon steel sheets from steel slabs by the ingot-making process as such steel slabs may also sometimes be susceptible to the occurrence of streaks.

DETAILED DESCRIPTION OF THE INVENTION

The present invention provides a process for producing a grain-oriented silicon steel sheet. The process is characterized in that coarse grains which have grown during high temperature slab heating are broken down in the subsequent hot rolling step, particularly in the finishing rolling step, in which the rolling conditions are controlled so as to perform controlled recrystallization rolling, and the steel sheet thus obtained is subjected to necessary treatments to obtain a steel sheet product which has undergone complete secondary recrystallization and is free from streaks after the final annealing.

The silicon steel slab to which the present invention can be applied consists of:

| | % by weight |
|---|---|
| Si | 2.0~4.0 |
| C | 0.085 or less |
| one or more of Al, N, Mn, S, Se, and Te as inhibitor(s) with the balance being iron and unavoidable impurities. | |

It is preferable that the silicon steel slab contain not more than 0.065% Al as the inhibitor element.

The reasons for the above limitations in the composition, particularly on the amounts of Si and C, are that inclusion of more than 4% of Si will cause difficulties in the cold rolling while less than 2% of Si will cause deterioration of the magnetic properties, particularly an increase in the core loss value. More than 0.085% of C on the other hand will make it difficult to perform complete decarburization annealing.

Therefore, the starting material used in the present invention can be produced by conventional steel making, melting and slab making methods, with the sole condition that its composition fall within the above defined range. The advantages obtained by the present invention are particularly significant when it is applied to continuous steel slabs.

According to the present invention, the starting material, namely the steel slab as defined above, is hot rolled into a hot rolled steel sheet and this hot rolled steel sheet is subjected to the conventional treating steps performed in the production of ordinary grain-oriented silicon steel sheets. These include one or more steps of cold rolling and annealing by which the sheet is reduced to its final thickness. Decarburization annealing and final annealing after cold rolling may be carried out in the conventional way.

The technical feature of the present invention lies in the hot rolling step. More specifically, the hot rolling step according to the present invention comprises several passes of rough rolling followed by several passes of finishing rolling. After the steel slab from the slab heating furnace has been rough-rolled to a predetermined size, it is further finish-rolled to a predetermined size for the hot rolled steel sheet. During at least one pass in the finishing rolling, the steel slab or sheet is subjected to recrystallization rolling (as will be defined hereafter) to break down the coarse grains produced in the high temperature slab heating step so as to obtain products of stable secondary recrystallization which are free from streaks in all subsequent steps. The recrystallization rolling may be performed during any desired pass or passes in the finishing rolling, the only condition being that at least one such rolling be performed.

The finishing rolling conditions in the hot rolling step play a very important role in the production of grain-oriented silicon steel sheet of stable secondary recrystallization free from streaks. The recrystallization rolling in the hot rolling step according to the present invention will now be described with reference to the drawings.

BRIEF EXPLANATION OF THE DRAWINGS

FIG. 2-1 is a photograph showing the grain structure of the steel slabs after the high temperature heating.

FIG. 2-2 is a photograph showing a cross section of a slab rolled under conditions falling in Zone A of FIG. 1.

FIG. 2-3 is a photograph showing a cross section of a slab rolled under conditions falling in Zone B of FIG. 1.

FIG. 2-4 is a photograph showing a cross section of a slab rolled under conditions falling in Zone C of FIG. 1.

FIG. 3-1 is a photograph showing the microstructure (×70) of a silicon steel slab (C:0.05%, Si: 2.9%) which was subjected to a solid solution treatment at 1350° C., cooled in air to 1100° C., and rapidly cooled in water.

FIG. 3-2 is a photograph showing the microstructure (×70) of a silicon steel slab identical to that shown in FIG. 3-1 and which was subjected to identical treatment except that, after being cooled in air to 1100° C., it was subjected to 30% reduction at 1100° C. and rapidly cooled in water.

FIG. 4-1, FIG. 4-2 and FIG. 4-3 are photographs respectively showing the macro-structures of the samples (1), (2) and (3) and 4 obtained in Example 1.

FIG. 5(*b*) is a graphic representation of the recrystallization behavior under the conditions specified in Example 2 (X represents the restored or non-recrystallized grains, Δ represents sub-grains, and o represents completely recrystallized grains).

A silicon steel slab extracted from the high temperature heating furnace and subjected to hot rolling undergoes changes in its grain structure which depend on the rolling reduction rate and the rolling temperature. The present inventors took an interest in these changes and conducted experiments in connection with finishing rolling with the aim of clarifying the grain structure behavior.

Figure 1:
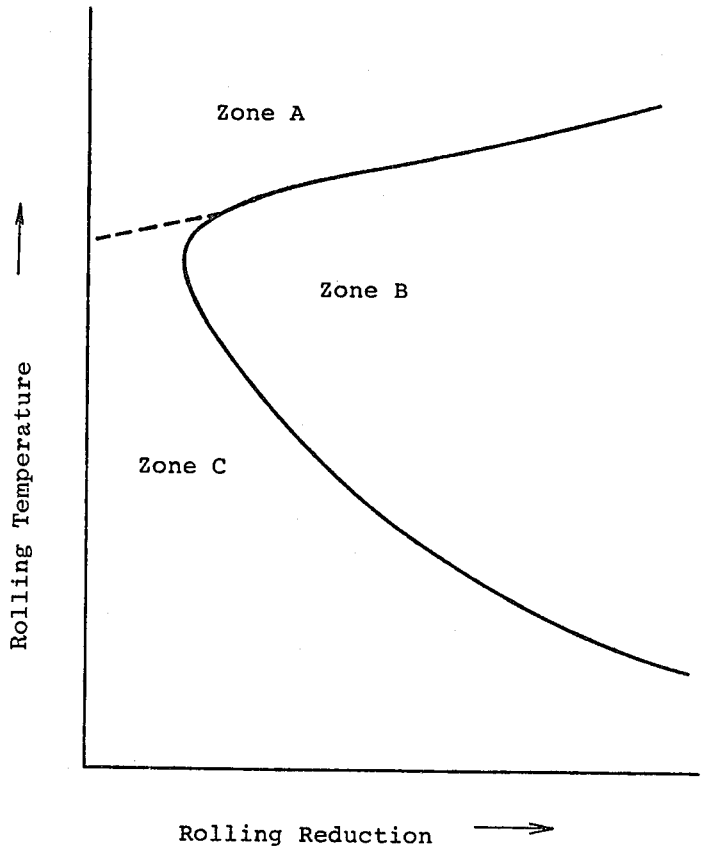
FIG. 1 is a graphical representation of the recrystallization behavior during hot rolling.

The relationship between the grain structure of a silicon steel slab or sheet and the working strain and rolling temperature at which it was finished rolled is graphically represented in FIG. 1.

Figures 1, 2:
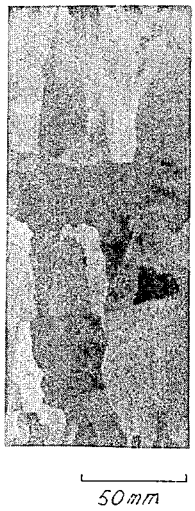
Figure 2:
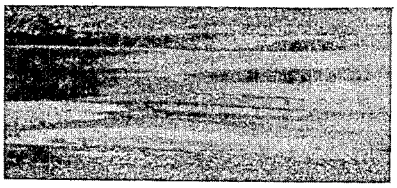

In FIG. 2-1, which shows the grain structure of a slab after the high temperature heating, the presence of the coarse grains is observed. When the slab is hot rolled under the conditions of Zone A in FIG. 1, grain restoration takes place and long coarse grains restored from the grains which escaped break-down and remained in their elongated form are present in the rolled structure as shown in FIG. 2-2. Rolling in Zone A corresponds to rough rolling.

The grain-oriented silicon steel slab is heated to a high temperature of 1300° C. or higher so as to dissolve the inhibitor element(s) and is then rough rolled into a steel slab of predetermined thickness. At this point, the slab temperature must be maintained as high as possible in order to prevent precipitation of the inhibitor element(s):

For this reason, the rough rolling is carried out at very high temperatures so that at this stage there is inefficient breaking down of coarse grains and recrystallization.

In Zone C recrystallization fails to occur because the rolling temperature and the rolling reduction rate are too low. When rolling is carried out in this Zone the coarse grains are not broken down and remain in their elongated form similarly to what occurs in Zone A. The grain structure obtained by rolling in this Zone is shown in FIG. 2-4.

Figures 2, 3:
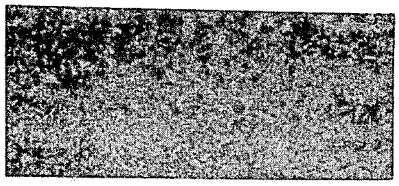
Figures 2, 3, 4:
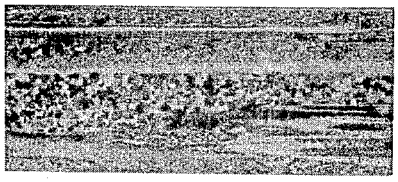
Figures 1, 3:
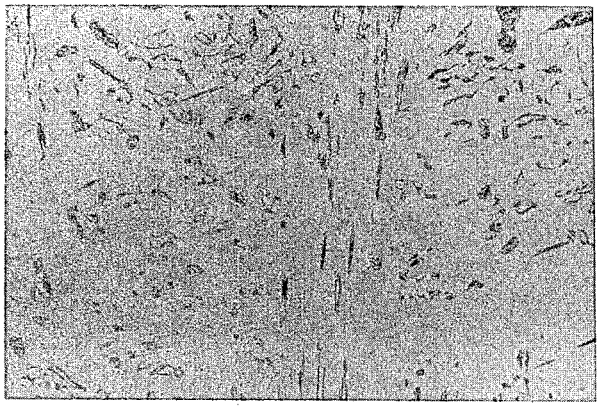
Figures 2, 3:
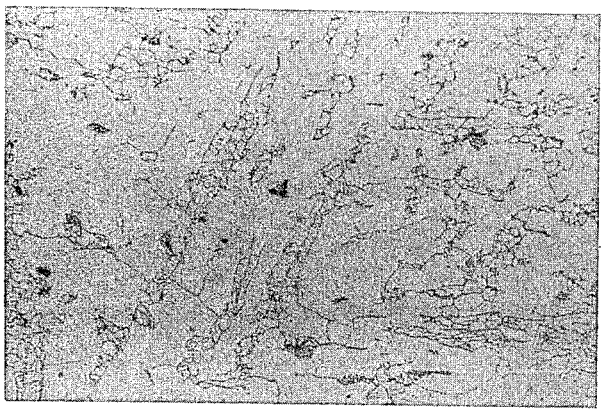
Figures 1, 4:
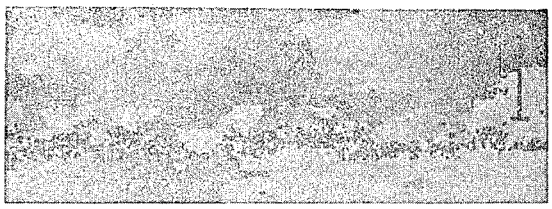
Figures 2, 4:
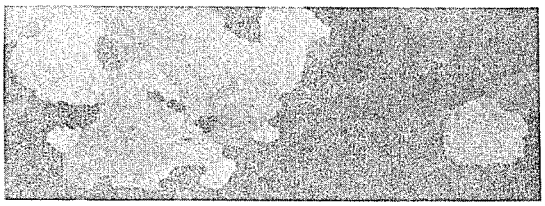
Figures 3, 4:
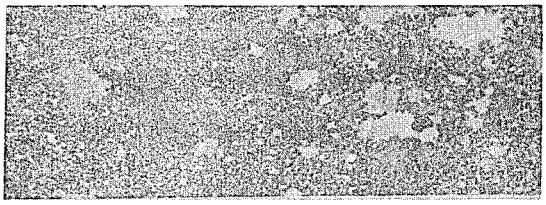

When rolling is conducted under the conditions of Zone B, the grains recrystallize and the structure is comprised of completely broken and finely recrystallized grains as shown in FIG. 2-3.

By "recrystallization rolling" in the present invention is meant rolling in the recrystallization Zone B of FIG. 1, and in this recrystallization rolling, it is important to select a suitable combination of rolling temperature and rolling reduction strain (which is controlled by selection of the reduction rate).

The recrystallization behavior which takes place during hot rolling in Zone B is thought to proceed as follows:

On the one hand, strain accumulates as the hot rolling progresses while on the other hand strain is simultaneously discharged through grain restoration. Recrystallization can take place only when the residual strain exceeds a certain minimum level. In Zone A of FIG. 1, the restoration proceeds so quickly as to prevent the residual strain from reaching the minimum level required for recrystallization to occur so that no recrystallization takes place. In Zone B, the restoration proceeds slowly and the residual strain reaches a high level so that the recrystallization proceeds. In Zone C, although the residual strain is large enough, the temperature is so low that the rate of recrystallization is retarded to such an extent that the degree of recrystallization cannot proceed to sufficient extent during hot rolling.

Prior to discussing specific rolling temperature and rolling strain (reduction rate) conditions, there is another significant observation of the inventors which must be introduced.

In examining the structures of silicon steel slabs before and after rolling, the inventors noticed the phenomena shown in FIGS. 3-1 and 3-2. FIG. 3-1 shows the micro-structure (×70) of a silicon steel slab (C: 0.05%, Si: 2.9%) which was subjected to solid solution treatment at 1350° C., cooled in air to 1100° C. and rapidly cooled in water. FIG. 3-2 shows the micro-structure (×70) of an identical sample treated under identical conditions except that, after it was cooled to 1100° C. in air, it was subject to rolling with 30% reduction and then rapidly cooled in water. It will be noted that the $\alpha \rightarrow \gamma$ transformation (as evidenced by the black precipitates in FIG. 3-1) had already occurred in the pre-rolled slab and that in the rolled slab shown in FIG. 3-2 recrystallized grains appeared near the $\gamma$ grains after the rolling.

The presence in the steel slab before rolling of portions, such as the $\gamma$ grains, which cause non-uniform deformations is highly advantageous since such portions act to promote recrystallization.

In order to even further promote the $\alpha \rightarrow \gamma$ transformation it is permissible to increase the amount of carbon inclusion (addition of a small amount of Cu, Ni etc. is also effective) or to maintain the slab at the recrystallization rolling temperature for a short time prior to recrystallization rolling.

It has been found through the experiments conducted by the present inventors that it is preferable for the recrystallized grain structure to be caused all across the thickness of the steel sheet. Nevertheless, the objects of the present invention can still be achieved even when the sub-grain condition remains in some local areas as viewed microscopically.

In order to obtain the desired structure, at least one reduction of not less than about 30%, preferably not less than about 50%, must be carried out in a temperature range from 1190° C. to 960° C., preferably from 1150° C. to 1050° C., during the hot rolling step. At least one reduction under these conditions constitutes the recrystallization rolling step of the present invention.

However, even when at least one recrystallization rolling is performed during the hot rolling pass, the amount of rolling in a temperature range lower than the recrystallization rolling range (this amount being considered as the ratio of such rolling to the total amount of hot rolling in terms of time, number of passes etc.) should be kept small. This is because in the case of Al-containing steel slabs, for example, rolling in the low temperature range will cause precipitation and coarsening of AlN with the result that secondary recrystallization in the subsequent steps will be incomplete so that the final product will have degraded magnetic properties. The precipitation and coarsening of AlN depends on the amount of Al and N inclusion but is generally most remarkable in the temperature range from 850° C. to 950° C.

In the foregoing, the recrystallization rolling is described as being carried out during the finishing rolling step of hot rolling as this is most preferable. However, conditions, permitting, the recrystallization rolling may be performed in the rough rolling step of the hot rolling.

Regarding the treatments following hot rolling, it is desirable, particularly for Al-containing silicon steel, for example, to anneal and rapidly cool the hot rolled sheet to precipitate AlN and to subject the sheet to one pass of strong cold rolling as this procedure is effective for the production of a grain-oriented silicon steel sheet having a high level of magnetic flux density and a low core loss value.

DESCRIPTION OF PREFERRED EMBODIMENTS

The present invention will be better understood from the following examples in which the finishing rolling conditions are more clearly illustrated.

EXAMPLE 1

A continuous steel slab 200 mm in thickness, containing:

C: 0.05% by weight
Si: 3.0% by weight
Al: 0.03% by weight was heated to 1400° C. and rolled in four passes into a bar 30 mm in thickness.

The structure after heating contained coarse grown grains as shown in FIG. 2-1.

The temperature of the bar immediately after the completion of the four rolling passes was 1250° C. Then four samples from the bar were finish-rolled under the following conditions into hot rolled sheets 2.3 mm in thickness.

| | First pass | Second pass | Third pass |
|---|---|---|---|
| Reduction rate | 73% | 63% | 24% |
| Sheet thickness | 8 mm | 3 mm | 2.3 mm |
| Sample | Rolling Temperature | | |
| (1) | 1220° C. | 1200° C. | 920° C. |
| (2) | 1200° C. | 1150° C. | 900° C. |
| (3) | 1100° C. | 1020° C. | 870° C. |
| (4) | 1000° C. | 900° C. | 780° C. |

The hot rolled sheets were continuously annealed at 1150° C., rapidly cooled, acid-pickled, then cold-rolled to a final thickness of 0.3 mm. The cold rolled sheets were subjected to decarburizing annealing at 850° C. and final annealing at 1200° C.

The macro-structures of the products thus obtained are shown in FIG. 4-1 to FIG. 4-3.

Sample (1) (FIG. 4-1) contains streaks deriving from the residual elongated coarse grains.

Sample (2) & (3) (FIG. 4-2) show complete secondary recrystallization.

Sample (4) (FIG. 4-3) shows incomplete secondary recrystallization due to the precipitation of inhibitor elements caused by more rolling passes in the low temperature zone.

It is understood from the above results that complete secondary recrystallization in the final product can be obtained by performing a strong rolling of not lower than 30% reduction at least one time in the recrystallization temperature range, namely from 1190° C. to 960° C., in which the inhibitor elements do not precipitate during the finishing rolling.

The magnetic properties of the above products are shown below.

| Sample | $B_{10}$(T) | $W_{17/50}$(w/kg) |
|---|---|---|
| (1) | 1.875 | 1.20 |
| (2) | 1.948 | 1.05 |
| (3) | 1.955 | 1.02 |
| (4) | 1.763 | 1.75 |

The samples (2) and (3) which were subjected to adequate recrystallization rolling at high reduction rates show excellent magnetic properties.

EXAMPLE 2

A continuous silicon steel slab 200 mm in thickness containing

C: 0.05% by weight
Si: 3.0% by weight
Al: 0.03% by weight was heated to 1400° C. and rolled into a bar 40 mm in thickness in four rolling passes. The temperature of the bar immediately after the completion of the four passes was 1250° C. Samples from the bar were subjected to one pass of rolling under the following conditions.

| Rolling temperature | Reduction rate |
|---|---|
| 1230° C. to 870° C. | 20 to 80% |

Figure 5:
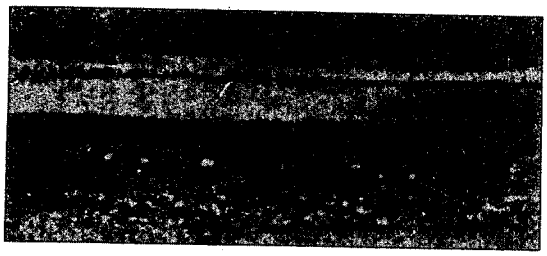
FIG. 5(*a*) is a photograph showing a cross section of a steel bar prior to the rolling in Example 2.
Figure 5:
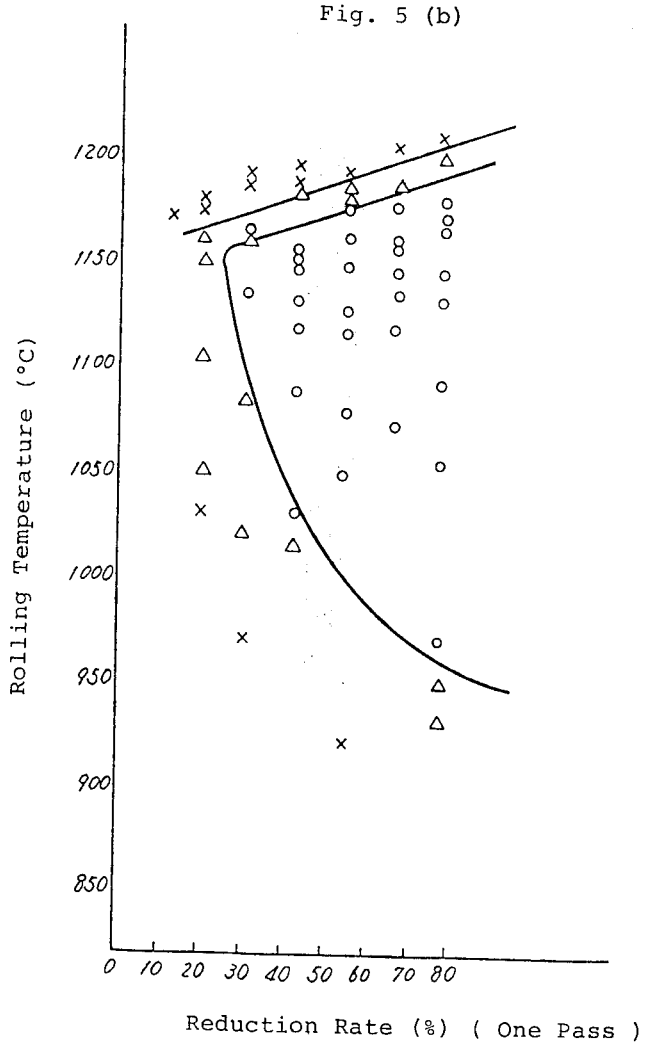

The grain structure of the bar prior to rolling is shown in FIG. 5(*a*) and the states of recrystallization of the various bar samples after the rolling are shown in FIG. 5(*b*).

The following conclusion can be drawn from the results obtained:

(1) The bar prior to the rolling contains restored elongated coarse grains.

(2) The elongated coarse grains are not broken down even by rolling at a high reduction rate insofar as the rolling is done at 1200° C. or higher.

(3) In the rolling temperature range from 1190° C. to 1160° C., rolling at a reduction rate of 50% or higher is required to obtain recrystallization.

(4) Even in the rolling temperature range from 1160° C. to 960° C. more complete recrystallization can be obtained by a reduction of 30% or higher.

(5) The elongated coarse grains remain in the non-recrystallized form when the rolling is done at 950° C. or lower.

Thus in order to break down the coarse grains and attain complete recrystallization, it is necessary to carry out at least one pass of reduction rolling in the temperature range from 1190° C. to 960° C. at a high single-pass reduction rate of at least 30% during the finishing rolling.

EXAMPLE 3

A steel bar of 40 mm in thickness was prepared from the same material and in the same way as in Example 2. This bar (1250° C.) was rolled under the following conditions:

| 40 mm → | First pass → | | | Second pass | |
|---|---|---|---|---|---|
| Rolling temp. | Reduction | Thickness | Sample | Rolling temp. | Reduction |
| 1200° C. | 60% | 16 mm | (1) | 1100° C. | 20% |
| | | | (2) | " | 30 |
| | | | (3) | " | 50 |

Figure 6:
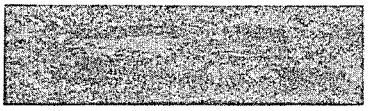
FIG. 6(*a*) to (*d*) are photographs showing in cross section the macro-structures of the hot rolled sheet after the first and second passes: (a)—after the first pass; (b)—after the second pass, 20% reduction; (c)—after the second pass, 30% reduction; and (d)—after the second pass, 50% reduction.
Figure 6:
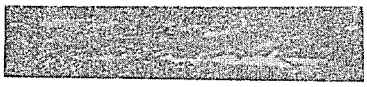
Figure 6:
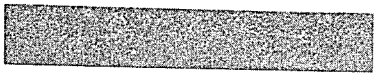
Figure 6:
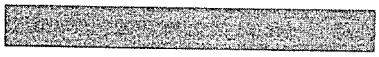

The grain structure after the first pass and those of the respective samples after the second pass are shown in FIG. 6(*a*) to FIG. 6(*d*).

Non-recrystallized elongated coarse grains are observed after the first pass. However, after the second pass, the samples rolled at 1100° C. with a reduction rate of 30% or more show complete recrystallization. Thus it is clear that among the several passes of finish rolling at least one pass must be performed at a reduction of 30% or higher at about 1100° C.

What is claimed is:

1. A process for producing a grain-oriented silicon steel sheet which comprises
   - continuously casting a silicon steel slab containing 2.0 to 4.0% by weight of silicon, up to 0.085% by weight of carbon, at least one conventional inhibitor, and unavoidable impurities,
   - heating the as cast slab to a temperature of at least 1300° C. to dissolve said inhibitors,
   - hot rolling the resultant heat-treated slab into a sheet, without any prior break-down step, said hot rolling comprising at least one recrystallization rolling, during finishing rolling, with a reduction rate of at least 30% per pass in a temperature range of from 960° to 1190° C., with the proviso that said inhibitors do not precipitate during said hot rolling, and
   - subjecting said sheet to annealing and cold rolling to produce a grain-oriented silicon steel sheet.

2. A process according to claim 1, wherein the recrystallization rolling is performed with a reduction rate of not less than 50% per pass.

3. A process according to claim 1, wherein the inhibitor is at least one member selected from the group consisting of Al, N, Mn, S, Se and Te.

4. A process according to claim 1, wherein the recrystallization rolling is performed in a temperature range of from 1050° to 1150° C.

5. A process according to claim 1, wherein said slab is heated to a temperature of at least 1350° C. prior to hot rolling.

* * * * *